United States Patent [19]

Young

[11] 4,311,449

[45] Jan. 19, 1982

[54] FORCED DRAUGHT FUEL BURNER

[75] Inventor: Walter H. Young, Scarborough, Canada

[73] Assignee: Pendell Boiler Limited, Toronto, Canada

[21] Appl. No.: 121,191

[22] Filed: Feb. 13, 1980

[51] Int. Cl.[3] ..... F23Q 9/00

[52] U.S. Cl. ..... 431/284; 239/423; 431/265

[58] Field of Search ..... 431/264, 265, 181, 186, 431/187, 284, 285; 239/398, 407, 402, 423, 424, 424.5, 402.5

[56] References Cited

U.S. PATENT DOCUMENTS

| | | | |
|---|---|---|---|
| 2,502,664 | 4/1950 | West | 239/402.5 |
| 2,603,280 | 7/1952 | Bernhard | 239/402 |
| 2,646,109 | 7/1953 | Banscher | 431/265 X |
| 3,049,173 | 8/1962 | Costello et al. | 431/265 X |
| 3,096,810 | 7/1963 | Martz | 431/265 X |
| 3,111,979 | 11/1963 | Peoples | 431/265 |

*Primary Examiner*—Edward G. Favors
*Attorney, Agent, or Firm*—Arne I. Fors; Robert F. Delbridge

[57] ABSTRACT

A forced draught fuel burner for use with gas or oil fuel and adapted to operate without swirl is disclosed in which a first inner cylindrical tube substantially concentric with and spaced from a blast tube defines an outer annular space having baffle means positioned within the outer annular space at the outlet ends of the pair of tubes, said baffle means having a substantially perpiheral circular opening of uniform cross-section for discharge of secondary combustion air, a second inner cylindrical tube having means for mounting said second inner tube substantially concentrically within said first inner tube for axial reciprocal travel therein, said second inner cylindrical tube having an inlet end and an outlet end and said second inner tube defining an inner annular space with said first inner tube, a diffuser ring having an outside diameter smaller than the diameter of the first inner cylindrical tube defining a narrow circular slot of uniform cross-section at the periphery of the inner annular space and a plurality of equispaced openings mounted at the outlet end of said second inner tube adapted to be seated within the inner annular space for discharge of primary combustion air from the said inner annular space, said second inner tube defining a central conduit, and closure means mounted in proximity to the inlet end of said second inner cylindrical tube for opening and closing said central conduit whereby an additional flow of primary combustion air through said central conduit can be adjusted.

14 Claims, 9 Drawing Figures

FIG.6.
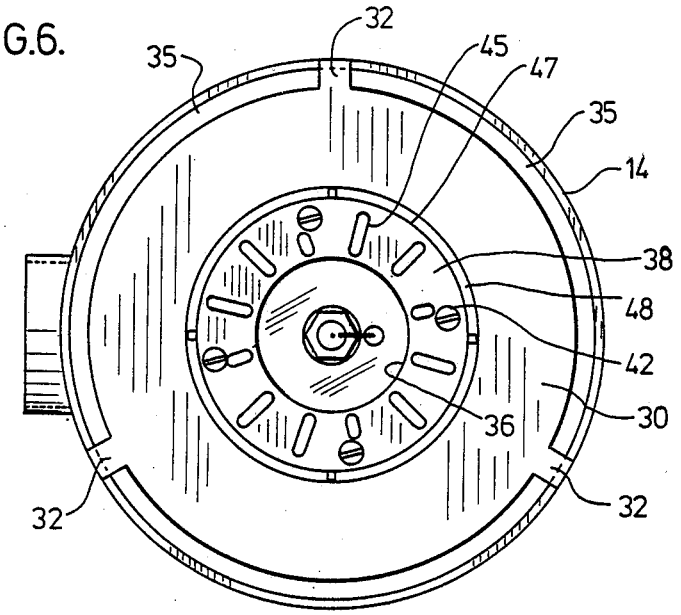
FIG.8.
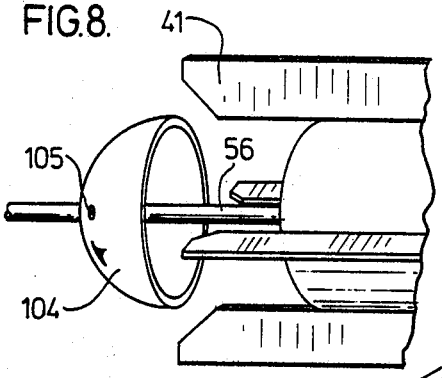
FIG.7.
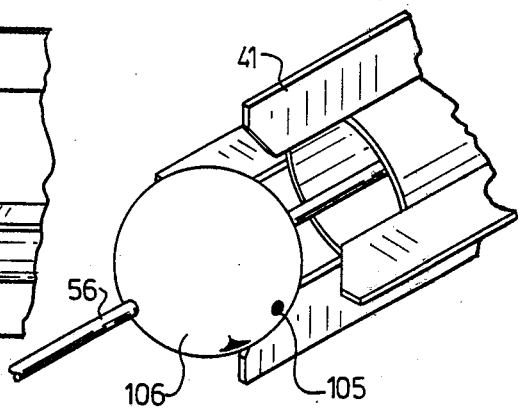
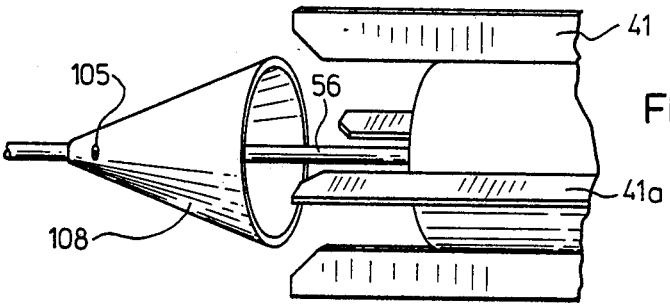
FIG.9.

FORCED DRAUGHT FUEL BURNER

This invention relates to an improved fluid fuel burner and, in particular, is directed to a novel power gas or oil burner for providing a non-pulsating, stable, concentric flame substantially free of swirl.

Power gas and oil burners, i.e. forced draft burners, are well known as typified by the disclosures of U.S. Pat. Nos. 1,797,570; 2,375,625; 3,367,385; and 3,687,600. These Patents show various embodiments of fluid fuel burners which generally impart a swirl to the fuel and combustion air in an attempt to improve efficiency of operation and completion of combustion. Such conventional gas and oil burners having a residual swirl imparted to the hot combustion products often are difficult to match, i.e. tune, with combustion chambers of different sizes and shapes.

U.S. Pat. No. 3,223,136 discloses a fluid fuel burner apparatus intended for use under either forced draught or natural draught conditions without swirl of combustion air. This apparatus does not permit facile adjustment for matching with a wide range of combustion chambers.

It is a principal object of the present invention to provide an improved fluid fuel burner which permits facile adjustment and efficient operation of the burner over a wide range of sizes, shapes and types of combustion chambers and associated boilers.

It is another object of the invention to provide an improved fluid fuel burner quiet in operation which establishes a non-swirling stable flame.

The burner of my invention comprises, in combination, a cylindrical blast tube adapted to be connected to a source of forced-draught combustion air and a source of fluid fuel, a first inner cylindrical tube substantially concentric with and spaced from said blast tube defining an outer annular space therebetween, said pair of substantially concentric tubes having inlet ends and outlet ends, baffle means positioned within the outer annular space at the outlet ends of the pair of tubes, said baffle means having a substantially peripheral circular opening of uniform cross-section for discharge of secondary combustion air, a second inner cylindrical tube having means for mounting said second inner tube substantially concentrically within said first inner tube for axial reciprocal travel therein, said second inner cylindrical tube having an inlet end and an outlet end and said second inner tube defining an inner annular space with said first inner tube, a diffuser ring having an outside diameter smaller than the diameter of the first inner cylindrical tube defining a narrow circular slot of uniform cross-section at the periphery of the inner annular space and a plurality of equispaced openings mounted at the outlet end of said second inner tube adapted to be seated within the inner annular space for discharge of primary combustion air from the said inner annular space, said second inner tube defining a central conduit, and closure means mounted in proximity to the inlet end of said second inner cylindrical tube for opening and closing said central conduit whereby an additional flow of primary combustion air through said central conduit can be adjusted, and means for discharging a fluid fuel into a flow of said combustion air. The liquid fuel may be fuel oil normally discharged centrally into the primary air or a gaseous fuel such as natural gas discharged into a contact zone between the primary and secondary air flows.

The foregoing and other objects of the invention and the manner in which they can be obtained will become apparent from the following detailed description of the invention, in which:

FIG. 6 is an end elevation of the structure of FIG. 4;

FIG. 7 is a perspective view of a spherical static closure;

FIG. 8 is a perspective view of a semi-spherical static closure; and

FIG. 9 is a perspective view of a conical static closure.

Like reference characters refer to like parts throughout the description of the drawings.

Figure 1:
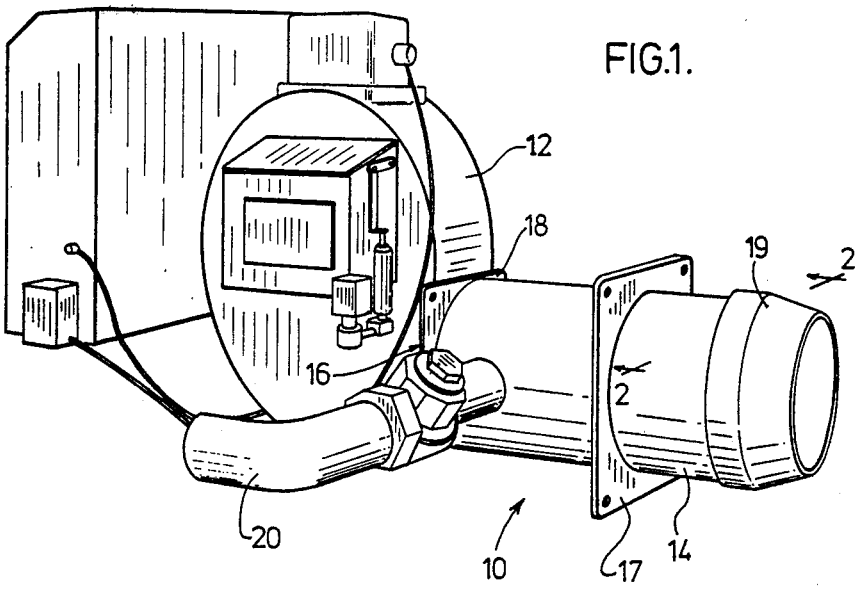
FIG. 1 is a perspective view of a fuel burner apparatus incorporating the structure of the present invention for use with a gaseous fuel.

With reference to FIG. 1, the structure of my invention designated generally by the numeral 10 is shown in combination with the volute 12 of a forced air blower, not shown, well known in the art for the provision of a supply of forced draught combustion air. Blast tube 14 is secured to the discharge 16 of volute 12 by flanged inner end 18. Rectangular mounting plate 17 is slidably fitted on blast tube 18 to accommodate variations in furnace dimensions. Truncated cone 19 normally completes the discharge end of blast tube 14. A fuel gas line 20, in the embodiment illustrated in this Figure, supplies a gaseous fuel such as natural gas to the burner.

Figure 2:
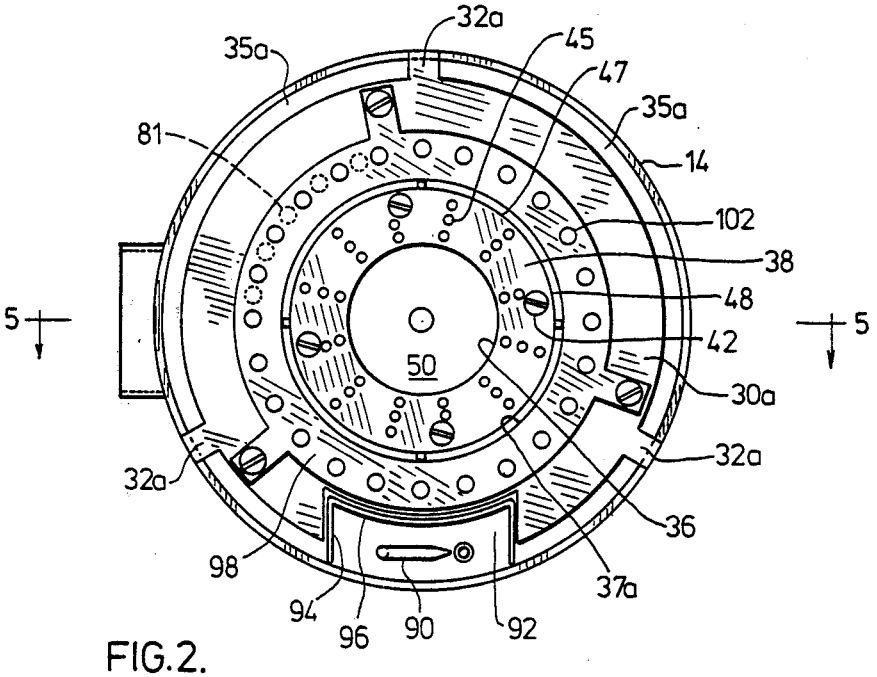
FIG. 2 is an end elevation along the line 2—2 of FIG. 1.
Figure 3:
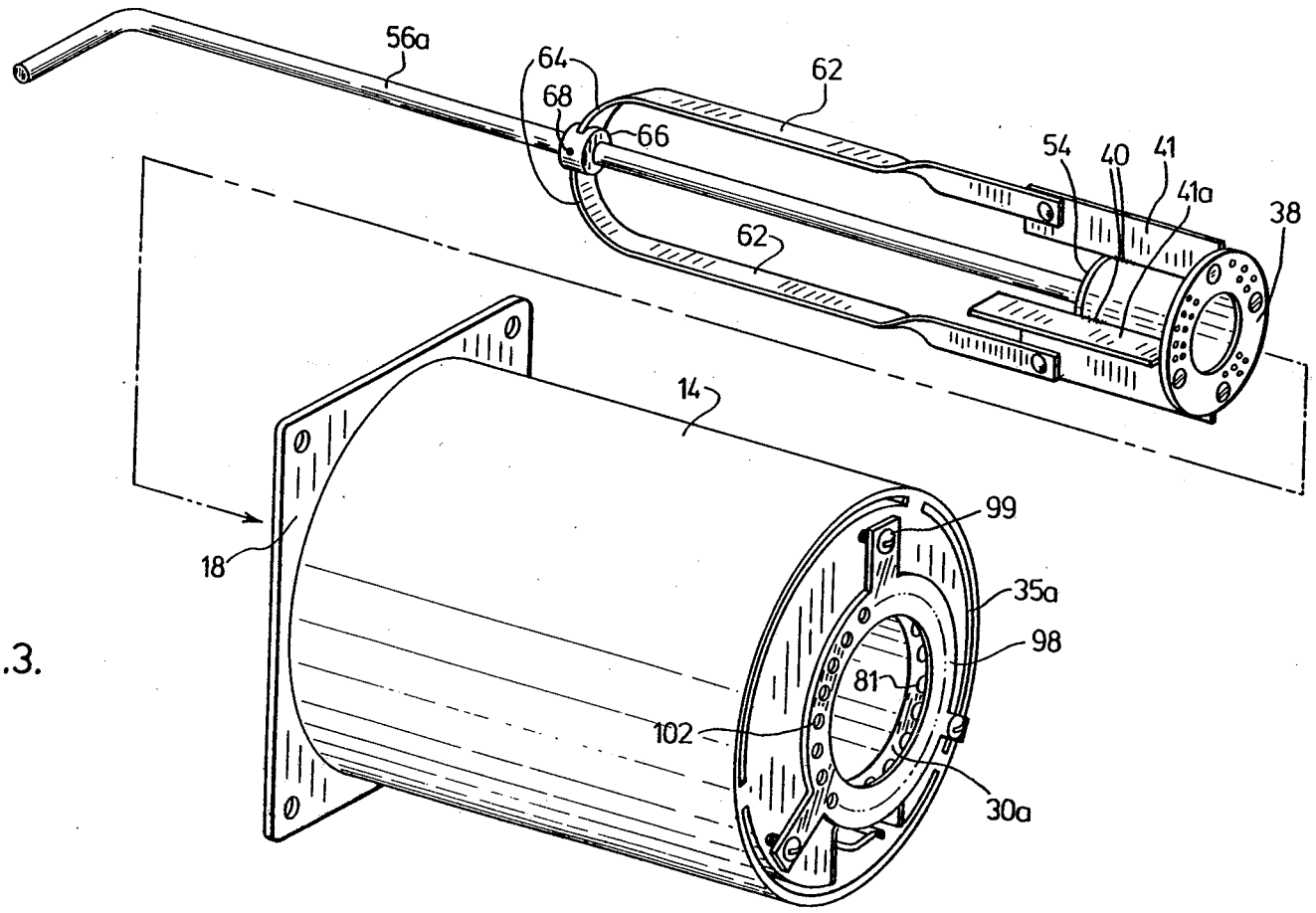
FIG. 3 is a perspective view of the apparatus of the invention axially separated to more clearly illustrate several components of the invention.
Figure 4:
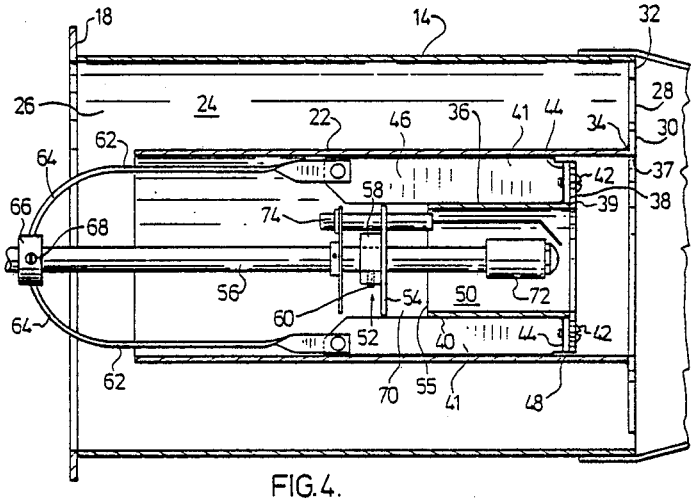
FIG. 4 is a longitudinal section illustrating the structure of an oil burner embodiment of the apparatus of the invention.
Figure 5:
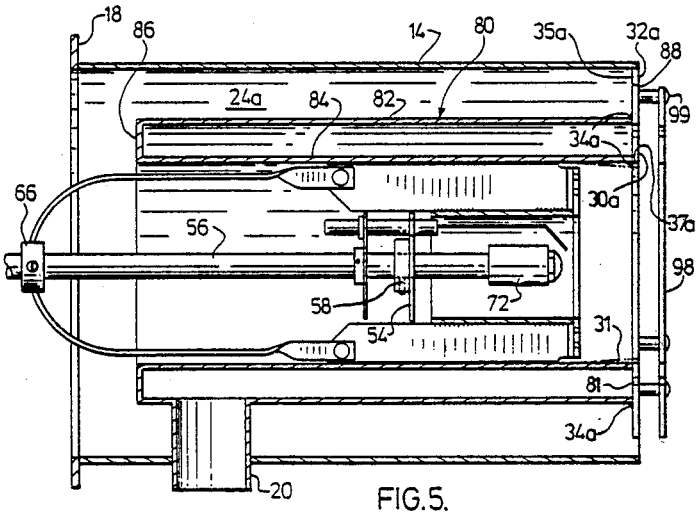
FIG. 5 is a longitudinal section of the embodiment of a burner of my invention taken along the line 5—5 of FIG. 2 additionally showing a combustion gas/oil burner adaptation.

The embodiments of the structure of my invention are shown more specifically in FIGS. 2–9; FIGS. 2, 3 and 5 directed to gas burners, FIG. 5 showing a combination gas/oil burner embodiment, FIGS. 4 and 6 directed to oil burners, and FIGS. 7–9 directed to embodiments of static closure devices.

With reference to FIGS. 4 and 6, the embodiment of my invention there illustrated, adapted for use with fuel oil, consists of blast tube 14 and a first inner cylindrical tube 22 supported substantially concentrically within tube 14 to define an annular space 24 having a rear inlet end 26 and a forward outlet end 28. The outlet ends of blast tube 14 and first inner tube 22 are substantially co-extensive with each other, first inner tube 22 being centrally supported at the outlet end by baffle ring 30, shown more clearly in the end view in FIG. 6. Baffle ring 30 is secured to blast tube 14 by radial tabs 32 preferably welded thereto and is secured to first inner tube 22 by an elongated weld 34. A substantially continuous circular slot 35 of uniform cross-section is formed about the periphery of baffle 30 to permit discharge of an annular flow of secondary air from annular space 24 forwardly into a combustion chamber. The inner edge 37 of baffle ring 30 normally is coterminus with first inner tube 22.

A second inner cylindrical tube 36 having a diffuser ring 38 secured to the outlet end 39 thereof is mounted substantially concentrically with first inner tube 22 by spacing means such as elongated radial spacers 41 shown diametrically opposed and secured to the outer surface of second inner tube 36 such as by a weld 40 and/or secured to the inner surface of diffuser ring 38 by screws 42 threaded into flanges 44. Diffuser ring 38 has a plurality of openings in the form of radially aligned slots 45, as shown in FIG. 6, or radial aligned holes (FIGS. 2 and 3), equally spaced angularly about the ring. The diameter of the periphery 47 of diffuser ring 38 is smaller than the inside diameter of inner tube 22 to define a narrow circular slot 48 of uniform cross-section at the outer edge of ring 38 for the discharge of an annular flow of primary air supplemented by the discharge of primary air from the radial slots 45 of diffuser ring 38.

A second pair of diametrically opposed spacers 41*a* angularly disposed at 90° to spacers 41 (FIG. 3), preferably are used with spacers 41 to centre second inner tube 36 within first inner tube 22 to define annular space 46 therebetween. It will be understood that other securing means such as three spacers angularly displaced at 120° to each other, or a single spacer or hanger slidably mounted in a slot, may be used to support inner tube 36 substantially centrally within tube 22.

A central conduit 50 defined by inner tube 36 has closure means 52 comprising, in the embodiment of FIG. 4, a circular static disc 54 slidably mounted co-axially on fuel oil tube 56 by collar 58 secured thereto for axial adjustment and securement on tube 56 by set screw 60. Second inner tube 36 has a pair of diametrically opposed rearwardly extending struts 62 converging at their rearward ends 64 to support collar 66 slidably mounted on tube 56 for axial adjustment of tube 36 within and relative to tube 22 by advancing or retracting collar 66 and locking the collar on tube 56 by use of set screw 68. Static disc 54 can be axially adjusted relative to the rear end 55 of inner tube 36 to open or close the gap 70 thus either by moving and locking collar 58 on tube 56 or by moving and locking collar 66 on tube 56.

Tube 56 functions as a fuel oil supply line terminating in fuel nozzle 72 which sprays a cone of atomised fuel forwardly into a combustion chamber. Electrical ignition electrode 74 is supported on tube 56.

In operation, primary air is discharged forwardly from the burner into a combustion chamber through circular slot 48 and diffuser slots 45, the rate of discharge being controlled by the static pressure of air in annular space 46, which in turn is controlled by a damper, not shown, in the air blower, and by the width of slot 48. Additional primary air is discharged through central conduit 50, the rate of discharge being controlled by the size of gap 70 defined between static disc 54 and rear inlet end 55 of second inner tube 36. The size of gap 70 can be adjusted by moving either of collars 58 or 66 axially on tube 56, as has been described above. Secondary air is discharged through circular peripheral slot 35 to form a forwardly extending annular flow of air substantially concentric with the annular flow of primary air flom slot 48.

Atomized fuel oil discharged radially outwardly in the form of a diverging cone from nozzle 72 into the primary flow of air through conduit 50 impinges on the two concentric, forwardly extending annular flows of air discharging through slots 48 and 35 for efficient combustion of the fuel and maintenance of an elongated stable flame, substantially free of swirl, extending forwardly from the burner. Second inner tube 36 supporting diffuser ring 38 can be readily advanced or retracted axially within tube 22 during operation of the burner by axial movement of tube 56 for fine adjustment and tuning of the flame and location of the flame stabilizing point.

FIGS. 2, 3 and 5 illustrate a second embodiment of my invention for combustion of a gaseous fuel. A cylindrical first inner tube 80 substantially concentric with blast tube 14 comprises a manifold tube having outer cylindrical wall 82 and inner cylindrical wall 84 closed at their rear ends by annular end plate 86 welded thereto.

The forward outlet ends of blast tube 14 and inner manifold tube 82 are substantially co-extensive with each other, the inner tube 82 being centrally supported at outlet end 88 by baffle ring 30*a*, shown most clearly in the end view of FIG. 2. Baffle ring 30*a* has radial tabs 32*a* welded to blast tube 14. Welds 34*a* secure ring 30*a* to manifold tube 80. Circular slot 35*a* of uniform cross-section is formed about the periphery of baffle ring 30*a* for the discharge of an annular flow of secondary air from annular space 24*a* forwardly into a combustion chamber. The inner edge 37*a* of baffle ring 30*a* is coterminous with the outside of inner wall 84 of manifold tube 80.

Baffle ringe 30*a* has a plurality of equispaced openings 81 in communication with the interior of manifold tube 80 for discharge of gas under pressure therefrom. Gas supply line 20 passes through blast tube 14 into outer wall 82.

A second inner cylindrical tube 36, as described above with reference to FIGS. 5 and 6, is slidably mounted within manifold tube 80 for axial travel. A fuel tube 56 functioning as a fuel oil supply line for nozzle 72 can be used to support static disc 54 for a combustion gas/oil burner, as depicted in FIG. 5, or a solid support rod 56*a*, as shown in FIG. 3, can be used for the gas burner shown in FIG. 2. An ignition electrode 90 is located in notch 92 of baffle ring 30*a*; channel member 94 having an ignition box 96 isolating notch 92 from the air in annular space 24*a*.

A mixing ring 98 secured a spaced uniform distance from baffle ring 30*a* by bolts 99 extending through radial tabs 100 into baffle ring 30*a* may have openings 102 equispaced thereon corresponding with and in alignment or offset (FIG. 2) from holes 81 in baffle ring 30*a*, or may be imperforate.

In operation, secondary air is discharged from circular peripheral slot 35*a* and primary air is discharged from circular slot 48, openings 45 and central conduit 50. Combustion gas is discharged from manifold tube 80 through openings 81 into a cylindrical contact zone between primary air from circular slot 48 and secondary air from circular slot 35*a* for efficient combustion of the gas and formation of an elongated stable flame, substantially free of swirl, extending forwardly from the burner. The stabilizing point of the flame can be controlled by axially advancing or retracting second inner tube 36 and diffuser ring 38 within tube 22 by means of tube 56 or rod 56*a* and by opening and closing gap 70 by adjustment of static disc 58. The axial adjustment of diffuser ring 38 and slot 48 varies air and pressure distribution and air flow pattern at the zone of entrainment of fuel with air permitting a wide range of operating parameters. The relative widths of slots 35, 35*a* to slot 48 can be changed by substitution of baffle and diffuser rings having different slot widths. For example, the width of each of slots 35,35*a* and 48 can vary from about 1.0 cm to about 3.5 cm for burners having blast tube inside diameters ranging from about 180 to about 340 cm, first inner tube diameters ranging from about 100 to about 180 cm, and second inner tube diameters ranging from about 57 to about 88 cm for second inner tube lengths of about 66 to about 90 cm respectively.

The closure means 52 may comprise a circular disc 54, as illustrated, or may comprise a sphere 106 as shown in FIG. 7, semi-sphere 104 as shown in FIG. 8, or cone 108 as shown in FIG. 9, all slidably mounted for axial adjustment on tube 56 or rod 56*a* and locked thereon by set screw 105. A locking collar, such as collar 58 as shown with static disc 54 and described above, may be preferred. Also, the base of semi-sphere 104 or cone 108 may abut the rear end 55 of tube 36 or the semi-sphere 104 or cone 108 reversed so that the rounded convex side of semi-sphere 104 of the tapered side of cone 108 abut or are inserted within tube 36 for improved air flow control upon axial movement of the semi-sphere or cone relative to the tube 36.

FIG. 5 illustrates an inward circumferential taper, depicted by ghost lines, at the outlet end of first inner tube 22. This embodiment of my structure permits close control of the width of slot 48 by advancing and retracting diffuser ring 38 in the zone of taper, in turn controlling the volume of air passing through the slot.

The tests reported in the following table are representative of the improved operation and results permitted by use of the apparatus of the present invention fired with natural gas fuel or fuel oil. A combination gas/oil burner having a blast tube diameter of 26.0 cm, slots 35*a* and 48 widths of 2.25 cm, first inner tube diameter of 15.0 cm, and second inner tube diameter and length of 7.5 cm and 7.8 cm was mounted in the combustion chamber of a boiler operated at 3–5 psi steam pressure with combustion air supplied at a low excess of 5 to 15% of the combustion gases. The gases were analyzed by a Chemoluminescence (Trade Mark) analyser.

| TEST # | INPUT Cu/Ft/Hr. or Gal/Hr. | COMBUSTION GAS ANALYSIS $O_2$ (%) | $CO_2$ (%) | CO (%) | $NO_x$(PPM) |
|---|---|---|---|---|---|
| 1 | 2000 | 5 | 9.9 | 0 | 60 |
| 2 | 3050 | 4.5 | 10 | 0 | 52 |
| 3 | 4250 | 4 | 10.4 | 0 | 53 |
| 4 | 10 | 6 | 11 | 0 | 82 |
| 5 | 14.0 | 2 | 14.5 | 0 | 96 |
| 6 | 34 | 1 | 15 | 0 | 100 |

Although conventional burners operate with sufficient combustion air to yield an excess of at least 15% air in the flue gas in an effort to obtain complete combustion and maintain a low nitrous oxide production, the average gas or oil burner produces 350–500 ppm nitrous oxides in the flue gas. The foregoing tests indicate that nitrous oxide levels are generally maintained below 100 ppm, particularly with natural gas fuel, albeit low levels of excess air, as represented by the low oxygen contents in the flue gases, are used.

What I claim as new and desire to protect by Letters Patent of the United States is:

1. An improved fuel burner comprising, in combination; a cylindrical blast tube adapted to be connected to a source of forced-draught combustion air and a source of fluid fuel; a first inner cylindrical tube substantially concentric with and spaced from said blast tube defining an outer annular space therebetween, said pair of substantially concentric tubes having inlet ends and outlet ends; baffle means positioned within the outer annular space at the outlet ends of the pair of tubes, said baffle means having a substantially peripheral circular opening of uniform cross-section for discharge of secondary combustion air; a second inner cylindrical tube having means for mounting said second inner tube substantially concentrically within said first inner tube for axial reciprocal travel therein, said second inner cylindrical tube having an inlet end and an outlet end and said second inner tube defining an inner annular space with said first inner tube; a diffuser ring having an outside diameter smaller than the diameter of the first inner cylindrical tube defining a narrow circular slot of uniform cross-section at the periphery of the inner annular space and a plurality of equispaced openings mounted at the outlet end of said second inner tube adapted to be seated within the inner annular space for discharge of primary combustion air from the said inner annular space, said second inner tube defining a central conduit; and closure means mounted in proximity to the inlet end of said second inner cylindrical tube for opening and closing said central conduit whereby an additional flow of primary combustion air through said central conduit can be adjusted; and means for discharging a fluid fuel into a flow of said combustion air.

2. A burner as claimed in claim 1, in which said means for mounting the second inner tube substantially concentrically with the first inner tube comprises at least one spacer interconnecting the second inner tube with the first inner tube for axial reciprocal travel of the second inner tube within the first inner tube.

3. A burner as claimed in claim 1, in which said means for mounting the second inner tube concentrically with said first inner tube for axial reciprocal travel comprises two pairs of diametrically opposed spacers secured to the diffuser ring and adapted to slidably fit within said first inner tube, and said means for opening and closing the inlet end of the central conduit comprising rearward extensions of a pair of said diametrically opposed spacers joining to support a sleeve in axial alignment with said tubes, a rod or tube mounted within said sleeve for axial reciprocal travel, and a closure means mounted on said rod or tube for slidable travel thereon adapted to abut and close the inlet end of the second inner tube.

4. A burner as claimed in claim 3, in which said closure means comprises a disc slidably concentrically mounted on said rod or tube, said disc having a diameter substantially equal to the diameter of the inner tube whereby said disc closes the central conduit upon abutment of the disc therewith.

5. A burner as claimed in claim 3, in which said closure means comprises a sphere slidably concentrically mounted on said rod or tube, said sphere having a diameter substantially equal to the diameter of the inner tube whereby said sphere closes the central conduit upon abutment of the sphere therewith.

6. A burner as claimed in claim 3, in which said closure means comprises a semi-sphere slidably concentrically mounted on said rod or tube, said semi-sphere having a diameter substantially equal to the diameter of the inner tube whereby said semisphere closes the central conduit upon abutment of the semisphere therewith.

7. A burner as claimed in claim 3, in which said closure means comprises a cone having a central axis passing through the apex and the base of the cone, said cone slidably concentrically mounted on the said rod or tube with the rod or tube passing through said apex and base, the base of the cone having a diameter substantially equal to the diameter of the inner tube whereby said base closes the central conduit upon abutment of the base of the cone therewith.

8. A burner as claimed in claim 1, 2 or 3, in which said means for discharging a fluid fuel comprises a liquid fuel nozzle disposed within said central conduit near the outlet end thereof.

9. A burner as claimed in claim 2 or 3, in which an additional cylindrical tube is disposed between the blast tube and first inner tube co-extensive therewith and closed at their inlet ends defining a manifold tube having a gaseous fuel annular space in communication with the fluid fuel supply, the baffle ring closing the outlet ends of the manifold tube and having a plurality of equispaced openings formed therearound for uniform discharge of said gaseous fuel from the manifold tube.

10. A burner as claimed in claim 1, 3 or 4, in which said plurality of equispaced openings in the diffuser ring are radially aligned slots formed about said ring.

11. A burner as claimed in claim 1, 3 or 4, in which said plurality of equispaced openings in the diffuser ring are radially aligned holes formed about said ring.

12. A burner as claimed in claim 9, in which a mixing ring substantially co-extensive with the openings in the baffle ring is secured to said baffle ring a spaced distance therefrom.

13. A burner as claimed in claim 12, said mixing ring having a plurality of openings formed therearound corresponding to and in alignment with the openings formed in the baffle ring.

14. A burner as claimed in claim 12, said mixing ring having a plurality of openings formed therearound corresponding to and out of alignment with the openings formed in the baffle ring.

* * * * *